United States Patent [19]

Scheel, deceased

[11] 4,098,325

[45] Jul. 4, 1978

[54] FLUID HEAT EXCHANGER

[75] Inventor: John R. Scheel, deceased, late of Ocqueoc, Mich., by Marie M. Scheel, executrix

[73] Assignee: Hawley Manufacturing Corporation, Indianapolis, Ind.

[21] Appl. No.: 702,978

[22] Filed: Jul. 6, 1976

[51] Int. Cl.[2] ..... F28F 3/08

[52] U.S. Cl. ..... 165/76; 165/164; 165/179; 165/DIG. 2

[58] Field of Search ..... 165/154, 5, 126, 128, 165/130, 131, 181, 169, 179, 160, 164, 76; 126/110 E, 102, 307; 122/228, 230

[56] References Cited

U.S. PATENT DOCUMENTS

| | | | |
|---|---|---|---|
| 2,311,226 | 2/1943 | Grotenhouse | 165/128 X |
| 2,387,583 | 10/1945 | Hess | 165/179 X |
| 3,399,720 | 9/1968 | Doelz et al. | 165/166 |

*Primary Examiner*—1
*Assistant Examiner*—Theophil W. Streule, Jr.
*Attorney, Agent, or Firm*—Jenkins, Coffey & Hyland

[57] ABSTRACT

A fluid heat exchanger comprising an exterior duct and an interior duct extending longitudinally and centrally through said exterior duct, each duct having an entry end port and exit end port. The interior duct comprises a lower wall, an upper wall and two opposed sidewalls extending generally perpendicularly therebetween, and a partition having exposed corrugated surfaces centrally disposed between and extending generally parallel to the sidewalls. The corrugations of the exposed surfaces extend generally transversely of the interior duct. The exterior duct has a lower wall, an upper wall, and two opposed sidewalls extending generally perpendicularly therebetween. The sidewalls of the exterior duct extend generally parallel to the sidewalls of the interior duct and have inwardly facing corrugated surfaces. The corrugations of the sidewalls extend generally transversely of the exterior duct. The sidewalls of the interior duct have a plurality of longitudinally extending vanes or fins thereon which project generally perpendicularly into the spaces between the interior and exterior sidewalls and between the interior sidewalls and the partition.

9 Claims, No Drawings

FLUID HEAT EXCHANGER

BACKGROUND OF THE INVENTION

This invention relates to a structure for fluid heat exchangers, and particularly air heat exchangers.

It is often desirable in fluid heat exchanger design to provide turbulence within both the cooling fluid and the fluid to be cooled to break up streamline flow and thereby increase convection heat transfer within both fluids.

It is known to provide vanes or fins in the path of streamline flow of fluids through a fluid heat exchanger to deflect the streamline fluid flow, inducing turbulence and therefore convection heat exchange.

It is thus an object of this invention to provide a simplified structure for insuring turbulent flow of fluids in a heat exchanger. Other objects of this invention will become apparent to those skilled in the art as this specification progresses.

In accordance with the present invention, a fluid heat exchanger comprises interior and exterior ducts and means communicating with each of the ducts for passage of fluids therethrough. The interior duct comprises a lower wall, an upper wall and, two opposed sidewalls extending generally perpendicularly therebetween, and a partition having exposed corrugated surfaces centrally disposed between, and extending generally parallel to, the sidewalls. The corrugations of the exposed surfaces extend generally transversely of the interior duct. The exterior duct has a lower wall, an upper wall and two opposed sidewalls extending generally perpendicularly therebetween. The sidewalls of the exterior duct are generally parallel to the sidewalls of the interior duct. The sidewalls of the exterior duct have corrugated inwardly facing surfaces. The corrugations of the sidewalls extend generally transversely of the ducts. The sidewalls of the interior duct have a plurality of vanes projecting generally perpendicularly thereof into the spaces between the interior duct sidewalls and the partition and into the spaces between the interior duct sidewalls and the exterior duct sidewalls.

As used throughout this specification and claims such words as lower wall, upper wall, floor, ceiling, sidewalls and the like are to be construed not as absolutes but merely as convenient references to the positions of the parts of the heat exchanger relative to one another, regardless of the position of the heat exchanger as a whole when in use.

The invention may best be understood by referring to the following specification and accompanying drawings of which:

Figure 1:
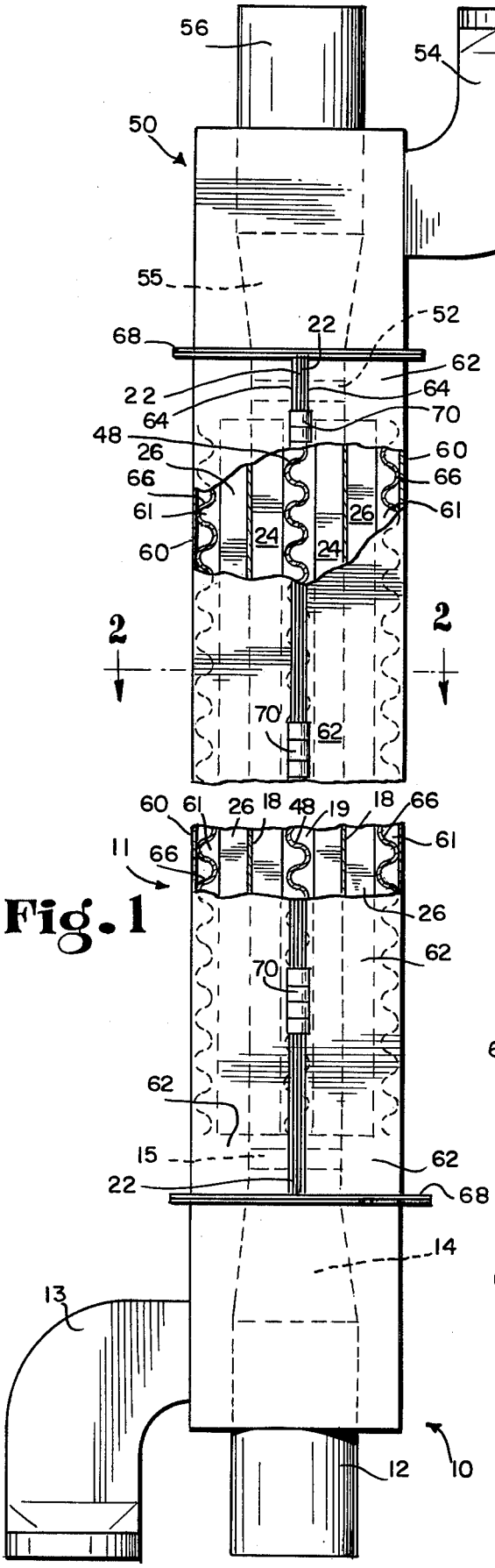
FIG. 1 is a top view, partially cut away, of a fluid heat exchanger constructed in accordance with the invention.
Figure 2:
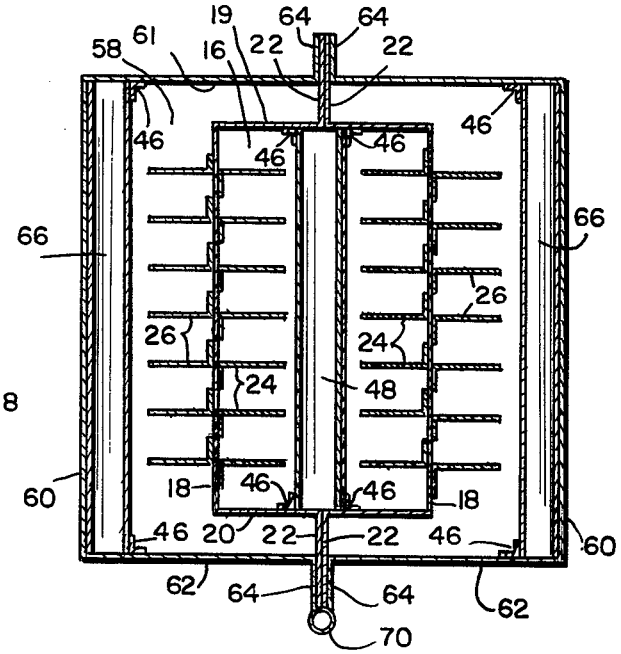
FIG. 2 is a partial sectional view thereof taken along section lines 2—2 of FIG. 1.

In the heat exchanger of FIGS. 1 and 2, a fluid to be cooled is introduced through an end section 10 into the heat exchanger 11. The fluid to be cooled enters the heat exchanger through a duct 12. From duct 12, fluid flows through a section of adapter duct 14 and a duct disconnect 15 to an interior duct 16 of generally rectangular cross section and having outer side walls 18, an upper wall or ceiling 19 and an opposed lower wall floor 20. Interior duct 16 is preferrably constructed of two like sections of generally U-shaped channel. Projecting outwardly from the upward extent of each wall of each section of channel at approximately right angles to the wall is a flange 22. The channels are joined along their respective flanges 22 by bolting, welding or other suitable method to form interior duct 16.

Figure 3A:
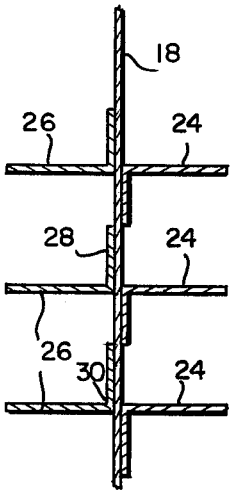
FIGS. 3*a–b* illustrate details of two alternate embodiments of the heat exchanger of FIGS. 1 and 2.
Figure 3B:
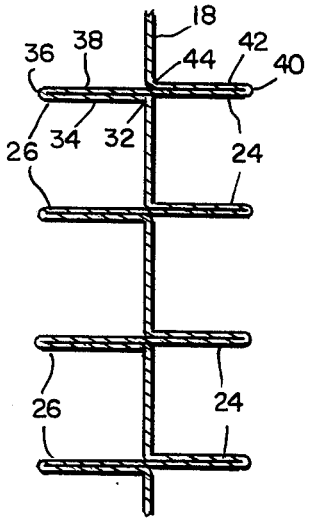

Protruding inwardly from each of walls 18 into interior duct 16 at approximately right angles are a plurality of equally spaced fins 24. Protruding outwardly from each of walls 18 are a similar plurality of equally spaced fins 26. Each set of fins 24,26 extend longitudinally of interior duct 16 for substantially the full length thereof. As shown in FIGS. 3*a–b* two alternative methods for forming fins 24,26 are presented for purposes of illustration.

In FIG. 3*a*, a plurality of lengths of L-shaped material each having a projecting fin portion 26 and a base portions 28 extending at right angles thereto from a bend 30 are attached to each of walls 18 of interior duct 16. Bases 28 of each of the L-shaped lengths are attached by bolting, welding or other suitable method in heat transferring relationship to walls 18.

In an alternative method for forming fins 24,26 illustrated in FIG. 3*b*, each of walls 18 is folded longitudinally along a bend line 32 to form an outwardly projecting portion 34. The wall is then folded back upon itself at 36 to form a portion 38. After traversing a length equal to the desired inward extent of fins 24, the wall is again folded back upon itself at 40 to provide a portion 42. At bend line 44, a final bend is put in wall 18 to form each pair of oppositely directed fins 24,26. The wall-fin structure of FIG. 3*b* is preferable for high-performance heat exchanging because welds and fastening elements tend to interrupt the transfer of heat.

Disposed interiorly of interior duct 16 and equidistantly on either side of the line at which flanges 22 are joined, are a plurality of angle brackets 46. Angle brackets 46 are attached by bolting, welding or other suitable method to the interiors of walls 19 and 20 for receiving and retaining therebetween a corrugated central partition member 48. The corrugated member 48 may be removably retained within the interior duct 16 to allow for its removal for maintenance and repair. The corrugations of the material extend transversely of the direction of fluid flow in interior duct 16. Corrugated partition 48 insures that the flow of fluid in the interior duct will be more turbulent as opposed to more streamlined or laminar flow. The more turbulent the flow of fluid inside duct 16, the more convection heat transfer occurs therein.

The fluid to be cooled, after having passed through the heat exchanger, passes through a duct disconnect 52, a length of adapter duct 55, and an exit duct 56 of end section 50.

A cooling fluid is conducted through a duct 54 in end section 50 to an exterior duct 58. Duct 58 is of generally rectangular cross section and has two opposed exterior side walls 60 joined by an upper wall or ceiling 61 and opposed lower wall or floor 62. Exterior duct 58 may be formed in the same manner as interior duct 16, i.e., of two lengths of U-shaped channel, each having a floor and a perpendicularly extending wall on each side edge thereof, each of the walls having a flange 64 extending outwardly therefrom at right angles thereto. Flanges 64 are joined by bolting, welding or other suitable method to form exterior duct 58. For example, the halves of both interior duct 16 and exterior duct 58 may be hinged along the line of joined flanges 22,64 as indicated by hinges 70 to provide access to the interior of the heat exchanger for ease of maintenance and repair. Flanges 22,64 of the interior and exterior ducts respectively may be joined to retain interior duct 16 in spaced relation to upper and lower walls 61 and 62 and side walls 60 of exterior duct 58.

A plurality of angle brackets 46 are also attached to the inside of the upper wall 61 and lower wall 62 of the exterior duct in spaced relation from the side walls 60. The spaces between side walls 60 and the upstanding legs of brackets 46 receive sheets of corrugated material 66. As with corrugated member 48 which formed the central partition in interior duct 16, members 66 may be removably received between sidewalls 60 of the exterior duct 58 and brackets 46 to aid in maintenance and repair of the heat exchanger. The corrugations of members 66 extend tranversely of exterior duct 58 to insure the turbulent flow of cooling fluid within exterior duct 58. Cooling fluid exits from the heat exchanger through duct 13 in end 10.

Flanges 68 at either end of the heat exchanger section 11 are provided for suitably attaching section 11 to ends 10 and 50. A plurality of sections 11 may also be coupled to one another to form heat exchangers with any desired heat exchanger capacity. Flanges 22,64 and 68 provide a ready means of assembly and disassembly of single length or multiple length heat exchangers for maintenance and repair.

Of course the fluid to be cooled can be made to flow in the exterior duct and the cooling fluid in the interior duct. Similarly, although this disclosure discussed only flow in opposite directions, i.e., counterflow, of the two fluids, it is understood that the heat exchanger operates as well with parallel flow of the two fluids, i.e., both entering at end 10 and exiting at end 50.

The inventive heat exchanger finds application particularly where air from within a foundry is drawn through the foundry furnace exhaust system to sweep away fumes and dust evolved in the processing of metals. The hot exhaust must be cleaned by passing it through filtering material. However, filtering material capable of withstanding hot exhaust is prohibitively expensive. A heat exchanger such as the one presented herein may be used to cool the exhaust prior to filtering, cooling air being passed through the exterior duct and the hot exhaust through the interior duct. The cooling air which will be heated thereby may also be used as make-up air for air drawn into the furnace exhaust system and to heat the foundry during cold weather.

A heat exchanger was built in accordance with this disclosure in two eight foot sections, the exterior duct of which has a square cross section of approximately twenty inches on each side and the interior duct of which is approximately nine inches wide and sixteen inches high. Both interior and exterior ducts were made of thirty gauge stainless steel. The fins protruded a distance of approximately three inches into both the interior and exterior ducts. The corrugated sheets used as a partition and inserted along the sidewalls of the exterior duct were all 18 gauge galvanized steel with corrugation bend radii of one and one half inches. Exhaust air at 970° F was passed through the interior duct at a rate of 2000 cubic feet per minute. Cooling air at 70° F was passed through the exterior duct at 2500 cubic feet per minute. The cooling air was heated to 120° F and the exhaust air was cooled to 350° F.

What is claimed is:

1. A fluid heat exchanger comprising an interior duct having a first pair of opposed sidewalls and a second pair of opposed sidewalls extending therebetween for defining a space within said interior duct and a partition centrally disposed between and extending generally parallel with said sidewalls of said second pair and having corrugated surfaces exposed to the interior of said interior duct, means providing communication with said interior duct for permitting flow of a first fluid therethrough, an exterior duct enclosing said interior duct, said interior duct extending longitudinally and centrally through said exterior duct, said exterior duct having a first pair of opposed sidewalls and a second pair of opposed sidewalls extending therebetween for defining a space within said exterior duct, said sidewalls of said second pair having corrugated surfaces exposed to the interior of said exterior duct, means providing communication with said exterior duct for, permitting flow of a second fluid therethrough, the second pair of sidewalls of said exterior duct extending generally parallel to the second pair of sidewalls of said interior duct, and a plurality of fins or vanes projecting generally perpendicularly of said second pair of sidewalls of said interior duct into the spaces defined within said interior and exterior ducts and extending longitudinally of said interior and exterior ducts, the corrugations of said corrugated surfaces extending generally transversely of the directions of fluid flow in said interior and exterior ducts for increasing turbulent flow of said first and second fluids respectively therethrough for increasing convection heat exchange within said first and second fluids.

2. A heat exchanger according to claim 1 wherein said fins are in pairs, one fin of each pair extending inwardly of said second pair of sidewalls of said interior duct and the remaining fin of each pair extending outwardly thereof.

3. A heat exchanger according to claim 1 including attachment means disposed within said interior duct for holding said partition therein, a pair of corrugated metal inserts providing said corrugated surfaces of said second pair of sidewalls of said exterior duct, and attachment means disposed within said exterior duct for holding said corrugated metal inserts.

4. A heat exchanger according to claim 1 wherein each of said interior and exterior ducts is formed from two sections of U-shaped channel, each said channel section having a pair of spaced-apart walls, the distal edges of which provide mating flanges, and means for connecting said flanges for holding said channel sections in inwardly facing relationship for defining each of said interior and exterior ducts, said connecting means including hinge means joining the mating flanges.

5. A fluid heat exchanger according to claim 1 wherein each said fin is formed by attaching one leg of an L-shaped strip of material to each said second sidewall of said interior duct.

6. A fluid heat exchanger according to claim 1 wherein each said fin is formed by making a plurality of longitudinal folds in each said second sidewall of said interior duct.

7. A fluid heat exchanger comprising an exterior duct, an interior duct extending longitudinally and centrally through said exterior duct, means providing communication with said interior duct for permitting passage of a first fluid therethrough, and means providing communication with said exterior duct for permitting passage of a second fluid therethrough, said interior duct comprising two generally U-shaped channel sections, each comprising two opposed walls and a third wall connecting said two opposed walls, the distal edge of each of said opposed walls providing a mating flange, said flanges abutting for disposing said two channel sections in inwardly facing relation, a partition having corrugated surfaces, and means for positioning said partition within said interior duct, said partition extending longitudinally of said interior duct along said joined flanges of said two U-shaped channel sections for exposing said corrugated surfaces of said partition within said interior duct, the corrugations of said corrugated surfaces extending transversely of the direction of fluid flow in said interior duct, and each of said channel third wall having a plurality of longitudinally and perpendicularly extending fins or vanes, some of said fins extending inwardly of said third wall toward said partition and some of said fins extending outwardly of said third wall, said exterior duct comprising two generally U-shaped channel sections, each comprising two opposed walls and a third wall connecting said two opposed walls, the distal edge of each of said opposed walls providing a mating flange, said flanges abutting for disposing said two channel sections in inwardly facing relation, each of said third walls of said channels of said exterior duct having an inwardly facing corrugated surface, the corrugations of said corrugated surfaces extending transversely of the direction of fluid flow in each of said channels, and fastening means for fastening said interior and exterior ducts together at said mating flanges, said fastening means comprising hinge means attached to the mating flanges on one of said opposed walls of each of the interior duct channel sections and the mating flanges of one said opposed walls of each of the exterior duct channel sections for permitting each of said interior and exterior ducts to be opened for maintenance and inspection without complete disassembly of said channel sections from one another.

8. A fluid heat exchanger according to claim 7 wherein said fins are in oppositely directed pairs and each said fin is formed by attaching one leg of an L-shaped strip of material to said floor of each said channel comprising

9. A fluid heat exchanger according to claim 7 wherein said fins are in oppositely directed pairs and each said fin is formed by making a plurality of longitudinal folds in each said floor of each said channel comprising said interior duct.

* * * * *

UNITED STATES PATENT OFFICE

CERTIFICATE OF CORRECTION

Patent No. 4,098,325 Dated July 4, 1978

Inventor(s) John R. Scheel, deceased

It is certified that error appears in the above-identified patent and that said Letters Patent are hereby corrected as shown below:

Column 1, last line, before "floor" insert -- or --.

Column 2, line 18, "tions" should be -- tion --.

Column 3, line 25, "exchanger" should be -- exchange --.

Column 4, line 18, delete the comma after "for" and before "permitting".

Column 5, lines 15, 17 and 18, "third wall" should be -- third walls --.

Column 6, line 9, after "one" insert -- of --;
Column 6, line 18, (Claim 8, last line), after "comprising" add -- said interior duct. --.

Signed and Sealed this

Thirteenth Day of March 1979

[SEAL]

Attest:

RUTH C. MASON
Attesting Officer

DONALD W. BANNER
Commissioner of Patents and Trademarks